US008948420B2

(12) United States Patent
Doller et al.

(10) Patent No.: US 8,948,420 B2
(45) Date of Patent: Feb. 3, 2015

(54) MEMS MICROPHONE

(75) Inventors: Andrew J. Doller, Sharpsburg, PA (US); Michael Peter Knauss, Pfullingen (DE); Philip Sean Stetson, Wexford, PA (US)

(73) Assignee: Robert Bosch GmbH, Stuttgart (DE)

( * ) Notice: Subject to any disclaimer, the term of this patent is extended or adjusted under 35 U.S.C. 154(b) by 369 days.

(21) Appl. No.: 13/196,652

(22) Filed: Aug. 2, 2011

(65) Prior Publication Data

US 2013/0034257 A1 Feb. 7, 2013

(51) Int. Cl.

| | |
|---|---|
| ***H04R 25/00*** | (2006.01) |
| ***H04R 19/00*** | (2006.01) |
| *H04R 31/00* | (2006.01) |

(52) U.S. Cl.

CPC ..... *H04R 19/005* (2013.01); *H04R 31/00* (2013.01); *H04R 2201/003* (2013.01)

USPC ..... 381/174; 381/175

(58) Field of Classification Search

None

See application file for complete search history.

(56) References Cited

U.S. PATENT DOCUMENTS

| | | | | |
|---|---|---|---|---|
| 6,594,369 | B1 * | 7/2003 | Une | 381/174 |
| 7,560,857 | B2 | 7/2009 | Chen et al. | |
| 7,795,078 | B2 | 9/2010 | Ramakrishna et al. | |
| 7,812,418 | B2 | 10/2010 | Hsu et al. | |
| 2006/0140431 | A1 | 6/2006 | Zurek | |
| 2008/0083958 | A1 | 4/2008 | Wei et al. | |
| 2008/0217709 | A1 | 9/2008 | Minervini et al. | |
| 2009/0001553 | A1 | 1/2009 | Pahl et al. | |
| 2009/0067659 | A1 * | 3/2009 | Wang et al. | 381/355 |
| 2009/0169035 | A1 | 7/2009 | Rombach et al. | |
| 2009/0310810 | A1 | 12/2009 | Wu et al. | |
| 2010/0183181 | A1 | 7/2010 | Wang | |
| 2010/0195864 | A1 * | 8/2010 | Lutz et al. | 381/433 |
| 2010/0276767 | A1 | 11/2010 | Liu et al. | |
| 2010/0303274 | A1 * | 12/2010 | Ryan et al. | 381/361 |
| 2012/0269363 | A1 * | 10/2012 | Suvanto | 381/107 |

FOREIGN PATENT DOCUMENTS

| | | |
|---|---|---|
| EP | 1992588 | 11/2008 |
| EP | 2037700 | 3/2009 |
| WO | 2009/016587 | 2/2009 |

OTHER PUBLICATIONS

Extended Search Report from the European Patent Office for Application No. 12177435.0 dated Dec. 5, 2012 (6 pages).

European Patent Office Examination Report for Application No. 12177435.0 dated Jul. 18, 2014 (5 pages).

* cited by examiner

*Primary Examiner* — Duc Nguyen

*Assistant Examiner* — Taunya McCarty

(74) *Attorney, Agent, or Firm* — Michael Best & Friedrich LLP

(57) ABSTRACT

A MEMS microphone. The MEMS microphone includes a substrate, a transducer support that includes or supports a transducer, a housing, and an acoustic channel. The transducer support resides on the substrate. The housing surrounds the transducer support and includes an acoustic aperture. The acoustic channel couples the acoustic aperture to the transducer, and isolates the transducer from an interior area of the MEMS microphone.

12 Claims, 10 Drawing Sheets

MEMS MICROPHONE

BACKGROUND

The invention relates to a MEMS microphone, specifically to packaging for a MEMS microphone that improves performance of the microphone.

MEMS microphones include a MEMS processed die, a substrate for making electrical input/output connections, and a separate housing with an acoustically perforated lid which structurally and electrically protects the die and bond wire connections. In some devices, an application specific integrated circuit (ASIC) is included on the same die as the MEMS. Generally, a large volume of air exists between the exterior of the housing and the active face of the MEMS die (i.e., a transducer). This volume of air causes a Helmholtz impedance/resonance which distorts the motion of the transducer of the microphone and, especially at high frequencies, the output of the microphone.

SUMMARY

In one embodiment, the invention provides a MEMS microphone. The MEMS microphone includes a substrate, a transducer support that includes or supports a transducer, a housing, and an acoustic channel. The transducer support resides on the substrate. The housing surrounds the transducer support and includes an acoustic aperture. The acoustic channel couples the acoustic aperture to the transducer, and isolates the transducer from an interior area of the MEMS microphone.

In another embodiment, the invention provides a set of frequency response matched MEMS microphones including a first MEMS microphone and a second MEMS microphone. The first MEMS microphone includes a first substrate, a first transducer support having a first transducer, a first housing, and an acoustic channel. The first transducer support resides on the first substrate. The first housing surrounds the first transducer support and includes a first acoustic aperture. The first acoustic channel couples the first acoustic aperture to the first transducer, and isolates the first transducer from an interior area of the first MEMS microphone. The second MEMS microphone includes a second substrate, a second transducer support having a second transducer, a second housing, and an acoustic channel. The second transducer support resides on the second substrate. The second housing surrounds the second transducer support and includes a second acoustic aperture. The second acoustic channel couples the second acoustic aperture to the second transducer, and isolates the second transducer from an interior area of the second MEMS microphone. A volume of an area between the first acoustic aperture and the first transducer is substantially equal to a volume of an area between the second acoustic aperture and the second transducer.

In another embodiment the invention provides a method of reducing a Helmholtz impedance/resonance in a MEMS microphone. The method includes attaching a transducer support to a substrate, the transducer support including a transducer, enclosing the transducer support in a housing, and isolating an exterior side of the transducer from an interior of the housing.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The figures and descriptions below provide examples of CMOS-MEMS single chip microphones that include a transducer (i.e., a diaphragm and stator) and an ASIC. The invention contemplates other constructions including separate MEMS chip and ASIC.

Figure 1:
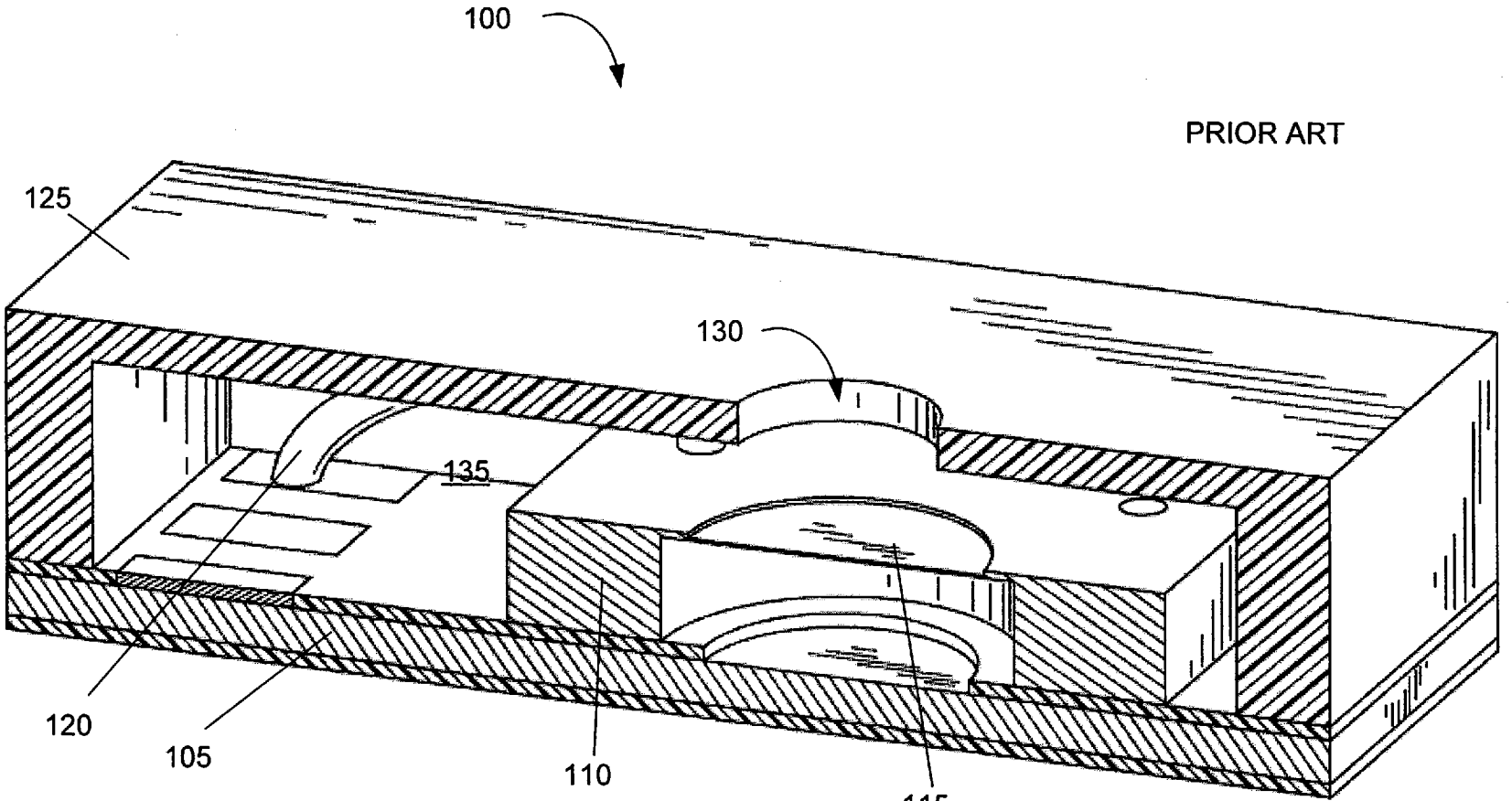
FIG. 1 is a cut-away view of a prior-art MEMS microphone.

FIG. 1 shows a cut-away view of a prior-art MEMS microphone 100. The microphone 100 includes a substrate 105, a transducer support 110, a transducer 115, a plurality of bonding wires 120 (one of which is shown in the figure), and a housing 125 having an acoustic aperture 130. Air pressure outside of the microphone 100 is propagated to the transducer 115 through the acoustic aperture 130. The construction of the microphone 100 results in a large Helmholtz cavity 135 inside the housing 125. As discussed above, the air in this cavity 135 distorts the motion of the transducer 115 causing Helmholtz impedance/resonance.

Figure 2:
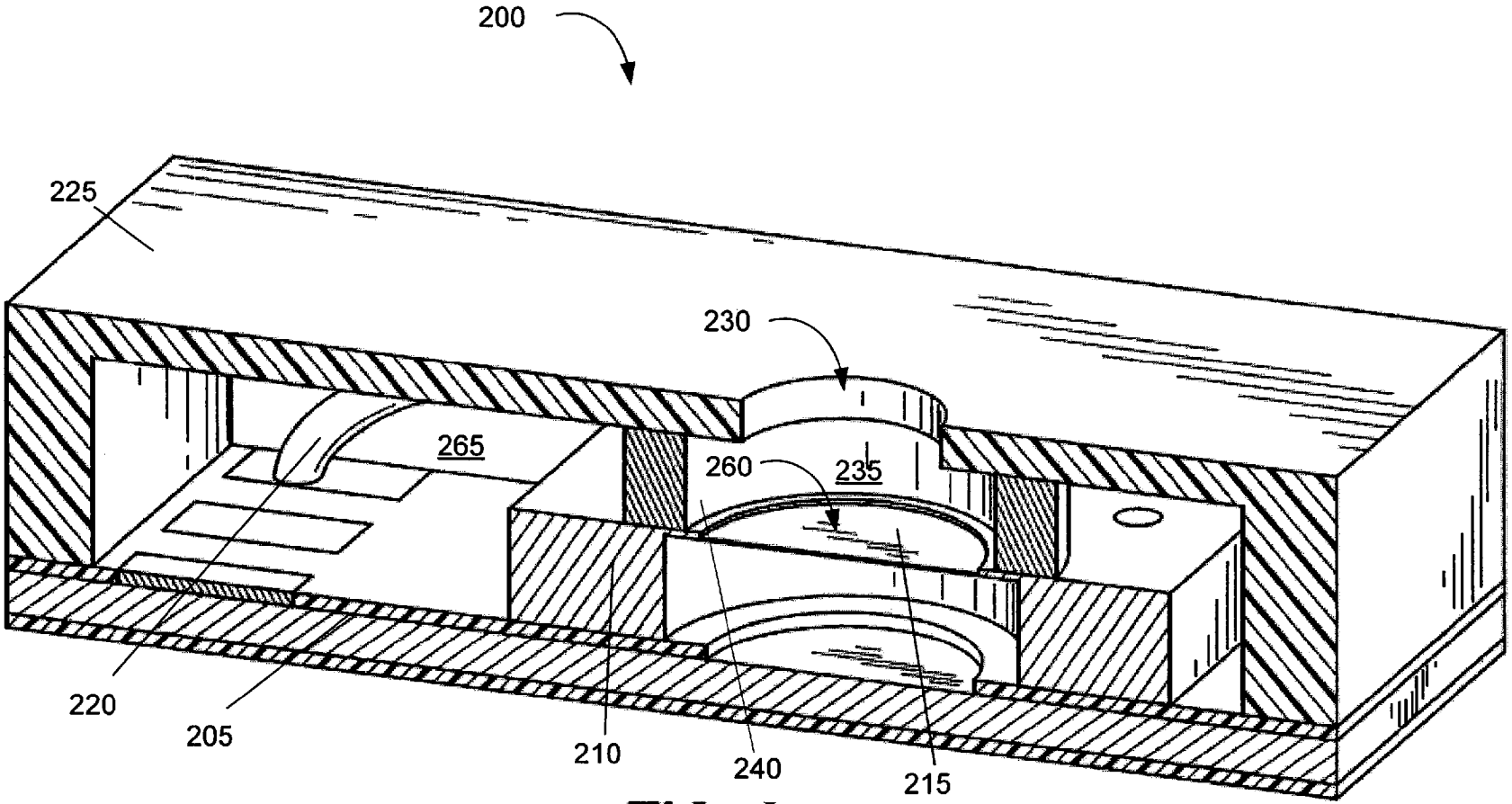
FIG. 2 is a cut-away view of a MEMS microphone having an acoustic channel.

FIG. 2 shows a cut-away view of a construction of a MEMS microphone 200 that improves on the performance of the prior-art microphone 100. The microphone 200 also includes a substrate 205, a transducer support 210, a transducer 215, a plurality of bonding wires 220 (one of which is shown in the figure), and a housing 225 (e.g., stamped metal or liquid crystal polymer (LCP) molded) having an acoustic aperture 230. In addition, the microphone 300 includes an acoustic channel 240 having a diameter substantially equal to or slightly larger than the diameter of the transducer 215. The acoustic channel 240 can be integrally formed as part of the housing 225 or as part of the transducer support 210. The acoustic channel 240 can be adhered to the structure of which it is not integrated (e.g., either the housing 225 or the transducer support 210) by a conformal coating or a pressure sensitive adhesive (PSA). Alternatively, the acoustic channel 240 can be a component separate from both the housing 225 and the transducer support 210. In such a construction, the acoustic channel 240 is adhered to both the housing 225 and the transducer support 210.

The acoustic channel 240 isolates an external side 260 of the transducer 215 from an interior 265 of the housing 225. The construction of the microphone 200 results in a much smaller air cavity 235 as compared with the prior-art air cavity 135, reducing Helmholtz impedance/resonance, and improving performance.

Figure 3:
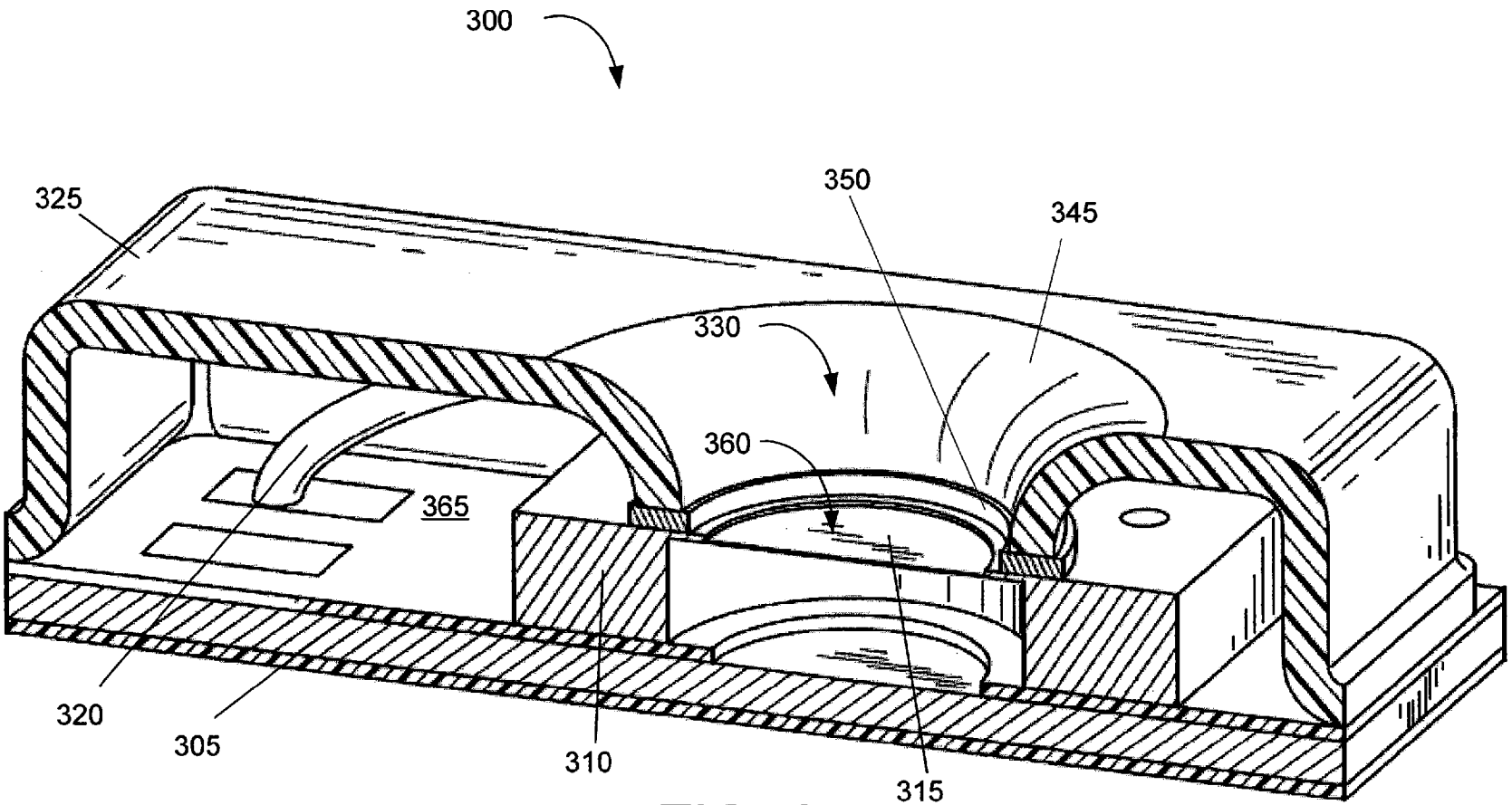
FIG. 3 is a cut-away view of a MEMS microphone having an acoustic channel formed as an inwardly depending arcuate flange.

FIG. 3 shows a cut-away view of an alternative construction of a MEMS microphone 300 that also improves on the performance of the prior-art microphone 100. The microphone 300 also includes a substrate 305, a transducer support 310, a transducer 315, a plurality of bonding wires 320 (one of which is shown in the figure), and a housing 325 (e.g., stamped metal or liquid crystal polymer (LCP) molded). The housing 325 includes an acoustic channel 330 formed as an inwardly depending arcuate flange 345 having a recessed aperture 350. The recessed aperture 350 is adhered to the transducer support 310 as described above. The recessed aperture 350 has a diameter that is approximately the same or slightly larger than the diameter of the transducer 315. This isolates an external side 360 of the transducer 315 from an interior 365 of the housing 325, resulting in essentially no air cavity, greatly reducing the Helmholtz impedance/resonance.

In some constructions, the aperture 230 of FIG. 2 is smaller than the diameter of the acoustic channel 240 to protect the transducer 215 from the environment (e.g., dust, dirt, water, etc.). In the construction shown in FIG. 3, the transducer 315 is exposed to the elements. Accordingly, a conformal coating can be applied to the transducer 315 to protect the transducer 315. In some constructions, the conformal coating is also applied to the inwardly depending arcuate flange 345.

Figure 4:
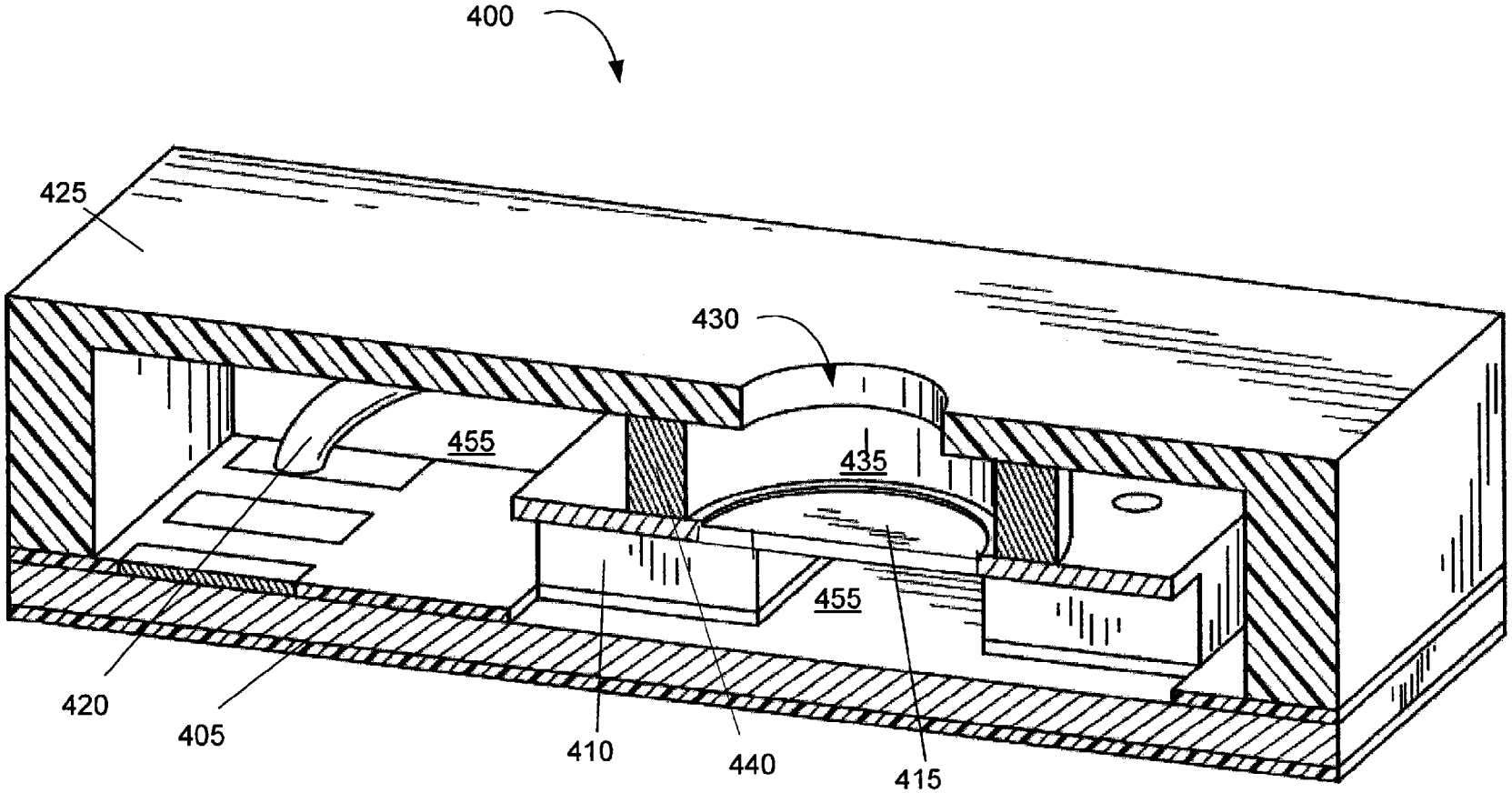
FIG. 4 is a cut-away view of a MEMS microphone having a transducer support etched away.
Figure 5:
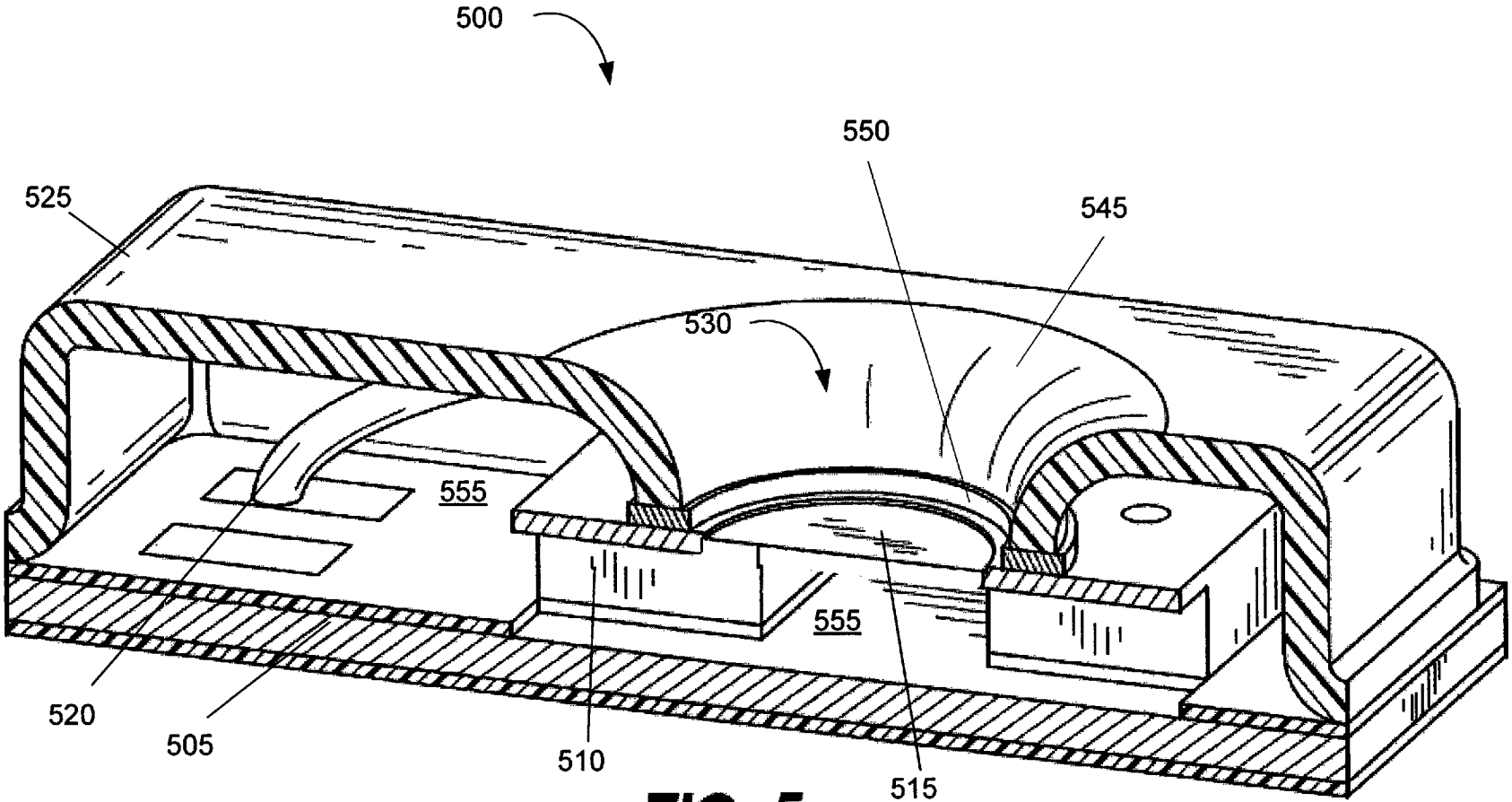
FIG. 5 is a cut-away view of a MEMS microphone having a transducer support etched away.

FIGS. 4 and 5 show alternative constructions of the microphones 400 and 500 (of FIGS. 2 and 3), respectively. In these constructions, a portion of the transducer support below the transducer 415/515 is etched away. This results in a much larger air cavity 455/555 behind the transducer 415/515, which in turn results in less back pressure on the transducer 415/515. The reduced back pressure results in better performance of the microphone 400/500.

Figure 6:
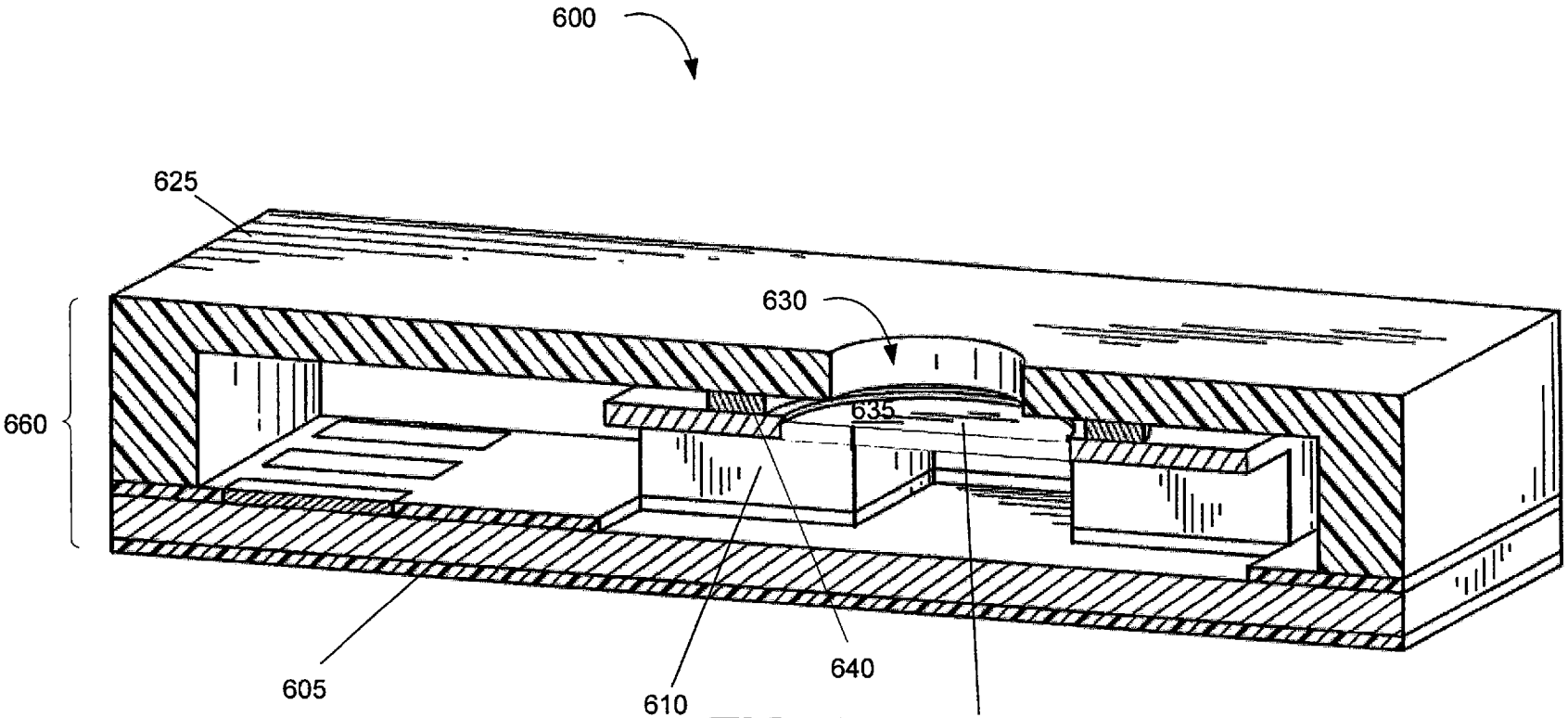
FIG. 6 is a cut-away view of a MEMS microphone having a reduced height.

FIG. 6 shows a cut-away view of another construction of a MEMS microphone 600 that results in a smaller size for the microphone 600. The microphone 600 includes a substrate 605, a transducer support 610, a transducer 615, and a housing 625 having an acoustic aperture 630. Unlike the previous constructions, the present construction does not include bonding wires inside the housing 625. Instead, in the construction shown, silicon vias/wires are used. The removal of the bonding wires enables a height 660 of the microphone 600 to be greatly reduced. The removal of bonding wires, through the use of silicon vias/wires, stud bumps, or other method, can be applied to any of the previously described constructions as well.

Figure 7:
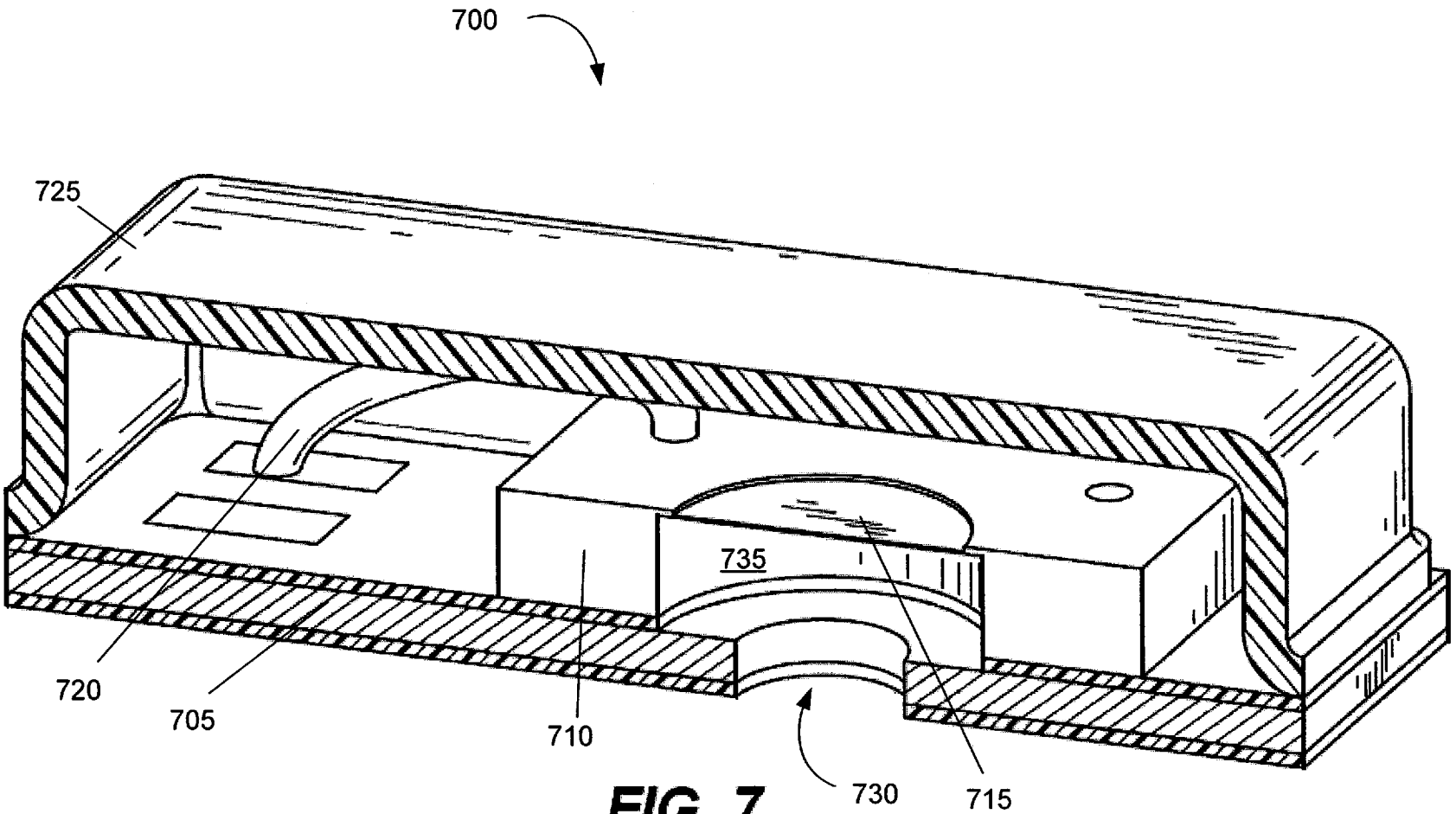
FIG. 7 is a cut-away view of a MEMS microphone having an acoustic aperture in a substrate.
Figure 8:
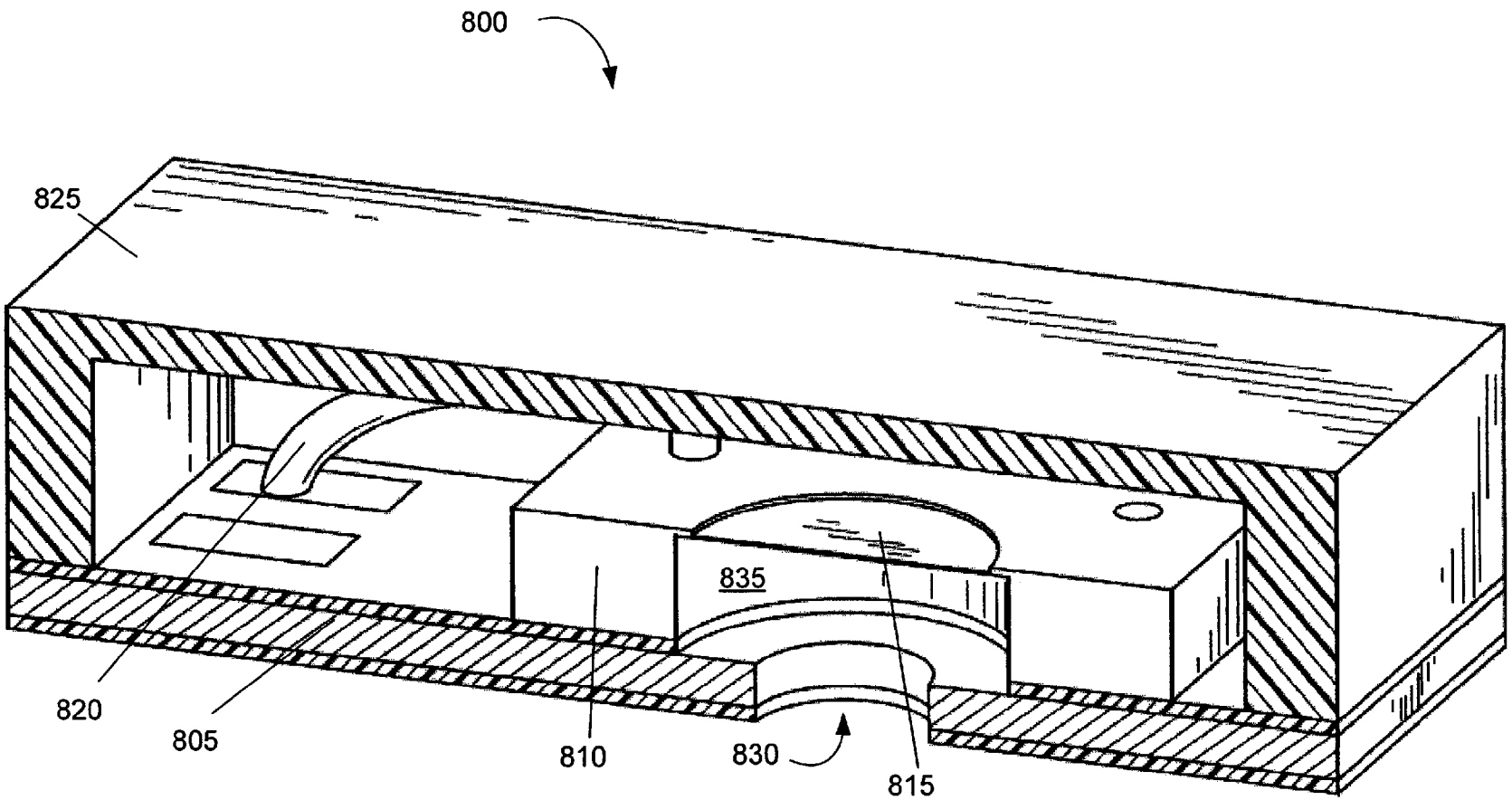
FIG. 8 is a cut-away view of an alternate construction of the MEMS microphone of FIG. 7.
Figure 9:
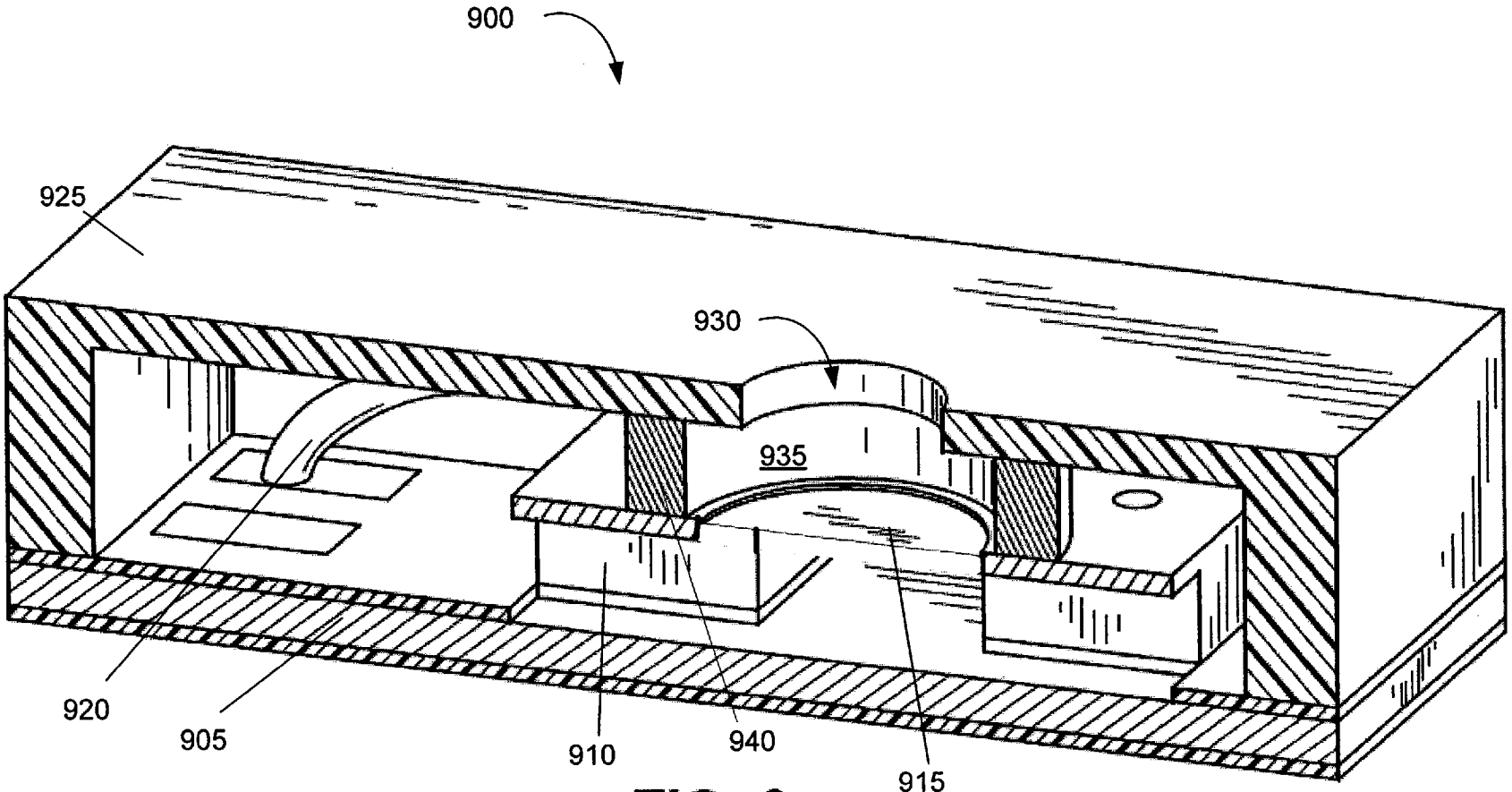
FIG. 9 is a cut-away view of a MEMS microphone having a frequency response matched to the frequency response of the MEMS microphones of FIGS. 7 and 8.

In some applications of MEMS microphones, it is desirable to have the acoustic link (port) to the transducer through the bottom (i.e., the substrate) of the microphone. In addition, some applications use more than one MEMS microphone. It is desirable that all of the microphones in an application have a similar frequency response. FIGS. 7-9 show cut-away views of MEMS microphones 700, 800, and 900 in which the frequency response is matched between a top ported microphone 900 (e.g., a first microphone) and bottom-ported microphones 700 and 800 (e.g., second microphones).

The top-ported microphone 900 includes a substrate 905, a transducer support 910, a transducer 915, a plurality of bonding wires 920 (one of which is shown in the figure), and a housing 925 (e.g., stamped metal or liquid crystal polymer (LCP) molded) having an acoustic aperture 930. In addition, the microphone 900 includes an acoustic channel 940 having a diameter substantially equal to or slightly larger than the diameter of the transducer 915, forming an acoustic chamber 935. The bottom-ported microphones 700/800 include a substrate 705/805, a transducer support 710/810, a transducer 715/815, a plurality of bonding wires 720/820, and a housing 725/825 (e.g., stamped metal or liquid crystal polymer (LCP) molded). The substrate 705/805 includes an acoustic aperture 730/830. In addition, the microphone 700/800 includes an acoustic channel 740/840 having a diameter substantially equal to or slightly larger than the diameter of the transducer 715/815. The transducer support 710/810 includes an open area 735/835 (i.e., an acoustic chamber) between the substrate 705/805 and the transducer 715/815.

Figure 10:
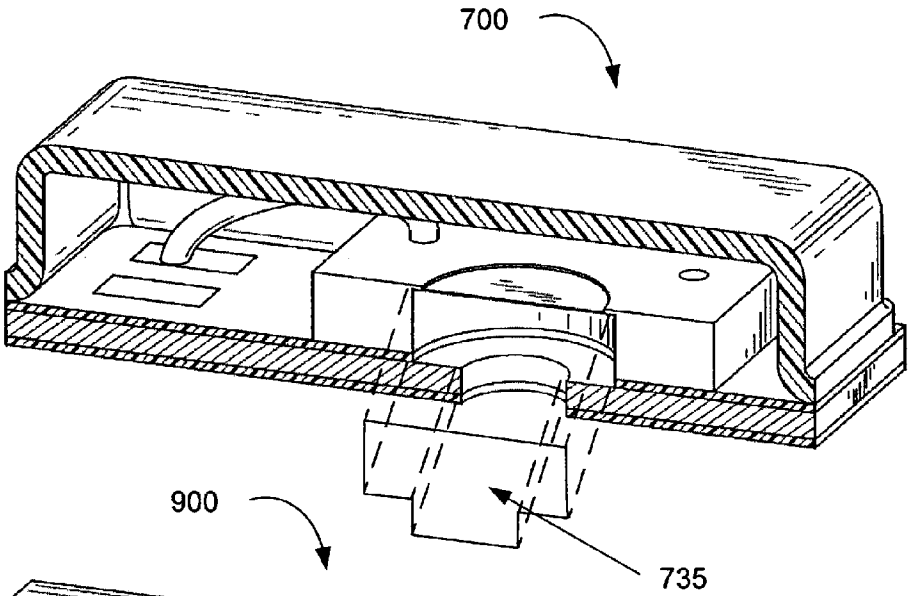
FIG. 10 is a cut-away view of the MEMS microphone of FIG. 7 showing a size of its acoustic chamber.
Figure 11:
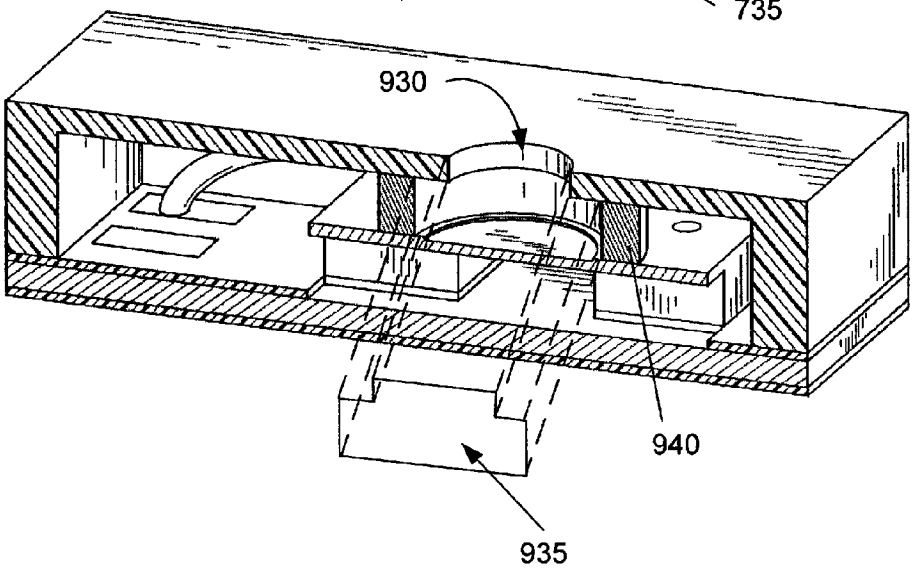
FIG. 11 is a cut-away view of the MEMS microphone of FIG. 9 showing a size of its acoustic chamber.

FIGS. 10 and 11 show cut-away views of the microphones 700 and 900 respectively along with an outline of the acoustic chambers 735/935.

The acoustic chamber (i.e., open area) 735 of the bottom-ported microphone 700 has substantially the same size and shape (i.e., volume) as the acoustic chamber 935 defined by the acoustic aperture 930 and acoustic channel 940 of the top-ported microphone 900. Because the open areas 735 and 935 are substantially the same for the top-ported and the bottom-ported microphones 900 and 700, any Helmholtz impedance/resonance will be substantially the same as well, resulting in a similar frequency response for each microphone. Microphone 800 also has an acoustic chamber 835 matching the acoustic chambers of the microphones 700 and 900.

The substrates described above can be created using many different materials. For example, FR4 circuit board material, FR4 with a ceramic layer, wafer stacking technologies, etc.

Various features and advantages of the invention are set forth in the following claims.

What is claimed is:

1. A set of frequency response matched MEMS microphones, comprising:

a first MEMS microphone including a first substrate, a first transducer support including a first transducer, residing on the first substrate, a first housing surrounding the first transducer support and including a first acoustic aperture, and a first acoustic channel coupling the first acoustic aperture to the first transducer, the first acoustic channel isolating an external side of the first transducer from an internal area of the first MEMS microphone; and a second MEMS microphone including a second substrate including a second acoustic aperture, a second transducer support including a second transducer, residing on the second substrate, a second housing surrounding the second transducer support, and a second acoustic channel coupling the second acoustic aperture to the second transducer, the second acoustic channel isolating an external side of the second transducer from an internal area of the second MEMS microphone;

wherein a volume of an area between the first acoustic aperture and the first transducer is substantially equal to a volume of an area between the second acoustic aperture and the second transducer; and wherein an internal side of the first transducer is exposed to an interior of the first housing and an internal side of the second transducer is exposed to an interior of the second housing.

2. The set of frequency response matched MEMS microphones of claim 1, wherein the first acoustic channel is integrally formed with one of the first housing and the first transducer support, and is adhered to the other of the first housing and the first transducer support.

3. The set of frequency response matched MEMS microphones of claim 1, wherein the second acoustic channel is formed out of the second transducer support.

4. The set of frequency response matched MEMS microphones of claim 1, further comprising a first ASIC integrated with the first transducer support.

5. The set of frequency response matched MEMS microphones of claim 1, further comprising a second ASIC integrated with the second transducer support.

6. The MEMS microphone of claim 1, wherein the first acoustic channel has a diameter slightly larger than a diameter of the first transducer.

7. The MEMS microphone of claim 1, wherein the first acoustic channel is an inwardly depending arcuate flange of the first housing having a recessed aperture.

8. The MEMS microphone of claim 7, wherein an exterior side of the first transducer is covered with a conformal coating.

9. The MEMS microphone of claim 7, wherein the recessed aperture has a diameter slightly larger than a diameter of the first transducer.

10. The MEMS microphone of claim 1, wherein the first acoustic channel is integrally formed with the first housing and is adhered to the first transducer support by one of a conformal coating and a pressure sensitive adhesive (PSA).

11. The MEMS microphone of claim 1, wherein the first acoustic channel is integrally formed with the first transducer support and is adhered to the first housing by one of a conformal coating and a pressure sensitive adhesive (PSA).

12. The MEMS microphone of claim 1, wherein a section of the first transducer support on the interior side of the first transducer is etched away, exposing the interior side of the first transducer to the interior of the first housing.

* * * * *